United States Patent [19]

Melton et al.

[11] 4,389,250

[45] Jun. 21, 1983

[54] MEMORY ALLOYS BASED ON COPPER OR NICKEL SOLID SOLUTION ALLOYS HAVING OXIDE INCLUSIONS

[75] Inventors: Keith Melton, Busslingen; Olivier Mercier, Ennetbaden; Helmut Riegger, Busslingen, all of Switzerland

[73] Assignee: BBC Brown, Boveri & Company Limited, Baden, Switzerland

[21] Appl. No.: 239,646

[22] Filed: Mar. 2, 1981

[30] Foreign Application Priority Data

Mar. 3, 1980 [EP] European Pat. Off. ..... 80200185.9

[51] Int. Cl.[3] ..... F16G 1/26

[52] U.S. Cl. ..... 75/232; 75/235; 420/486; 420/489

[58] Field of Search ..... 75/232, 235, 162; 420/486, 489

[56] References Cited

U.S. PATENT DOCUMENTS

| | | | |
|---|---|---|---|
| 2,947,068 | 8/1960 | Nachtman | 75/235 |
| 3,783,037 | 1/1974 | Brook et al. | 148/11.5 R |
| 4,019,925 | 4/1977 | Ninno et al. | 148/11.5 R |
| 4,285,739 | 8/1981 | Deruyttere et al. | 148/11.5 C |
| 4,292,079 | 9/1981 | Pickens et al. | 75/232 |

*Primary Examiner*—O. R. Vertiz
*Assistant Examiner*—Gregory A. Heller
*Attorney, Agent, or Firm*—Oblon, Fisher, Spivak, McClelland & Maier

[57] ABSTRACT

Fine grained copper-based or nickel-based memory alloys having a matrix of $\beta$-high temperature phase with metal oxide particles dispersed in the matrix which act to retard grain growth have improved mechanical characteristics such as elongation, toughness and workability, compared to cast and worked alloys. These alloys are produced by powder metallurgy.

8 Claims, No Drawings

MEMORY ALLOYS BASED ON COPPER OR NICKEL SOLID SOLUTION ALLOYS HAVING OXIDE INCLUSIONS

BACKGROUND OF THE INVENTION

1. Field of the Invention

This invention relates to memory alloys and more particularly to memory alloys based on copper and nickel alloys having oxide inclusions.

2. Description of the Prior Art

Memory alloys based on copper and nickel are known and have been described in various publications (e.g. U.S. Pat. No. 3,783,037 and U.S. Pat. No. 4,019,925). Such memory alloys, which belong generally to the type having a $\beta$-high temperature phase, are usually produced by fusion techniques.

When these alloys are cast they usually exhibit a coarse texture which becomes still coarser because of grain growth during subsequent annealing in the temperature range of the $\beta$-phase solid solution and which cannot be reversed by hot working. As a result the mechanical characteristics, particularly elongation and notch ductility, of memory alloys produced in this manner are relatively poor and their field of application is limited.

It has already been proposed to produce memory alloys of the Cu/Zn/Al type by powder metallurgy, starting with previously prepared alloys corresponding to the final composition (e.g. M. Follon, E. Aernoudt, Powder-metallurgically processed shape-memory alloys, 5th European Symposium on Powder Metallurgy, Stockholm 1978, pp. 275–281). The prepared powder is encapsulated, cold compacted, hot compacted and extruded. However, this method is not suited for the production of compact and dense articles of Cu/Al/Ni and Ni/Al, because the powder does not cohere and the compacts disintegrate.

Therefore a need has continued to exist for improved memory alloys suitable for preparation by powder metallurgy.

SUMMARY OF THE INVENTION

Accordingly, it is an object of this invention to provide memory alloys based on Cu/Al, Cu/Al/Ni and Ni/Al compositions.

A further object is to provide memory alloys which can be formed by powder metallurgy into dense compacts having good mechanical properties, exactly reproducible transition temperatures, and other quantitative characteristics of memory alloys.

Other objects of the invention will become apparent from the description which follows.

The objects of the invention are attained by a memory alloy, based on copper or nickel solid solution alloys, which has the $\beta$-high temperature structure, has a fine grained texture with a crystallite diameter of at most 100 $\mu$m, and contains at least one metal oxide in the form of finely divided inclusions dispersed in the matrix formed by the $\beta$-phase.

The memory alloys of the invention are conveniently prepared by powder metallurgy. The metal oxides which are embedded in the matrix in the form of finely divided inclusions may be introduced into the final product as distinct powdered materials or as natural constituents of the raw materials.

DETAILED DESCRIPTION OF THE INVENTION AND PREFERRED EMBODIMENTS

The memory alloys of the invention are prepared by powder metallurgy, starting from a mixture of pre-alloyed powders and specially compounded powder mixtures. They do not have to be prepared starting from metal powders having a composition corresponding to that of the final alloy. Consequently, the ductility required for production of the memory alloys can be obtained without narrow limitations on the composition. Furthermore, the grain size in the final product can be for the most part predetermined, because grain growth is prevented by the presence of the finely divided oxide inclusions. On the other hand, oxide shells which impede homogenization and adversely affect the mechanical properties are avoided.

$Al_2O_3$, $Y_2O_3$ and $TiO_2$ or any mixture of these oxides are preferred as suitable inclusions. They should preferably make up 0.5 to 2% by weight of the total mass of the alloy, and the particles preferably have an average diameter of about 1.0 nm to 1 $\mu$m.

$Al_2O_3$ can be advantageously introduced in the form of the oxide coating of the powder, e.g., aluminum or an aluminum pre-alloy, used in the production process. In this case the powders can be mixed in a tumbler mixer. $Y_2O_3$ and $TiO_2$ individually in the form of very fine particles are mixed with the metal powder, then ground and mechanically alloyed under an organic solvent which wards off atmospheric oxygen (toluene, ethyl alcohol) in a ball mill or an attritor.

The mixtures of metal powders and oxide powders may then be formed into shaped articles by the known procedures of powder metallurgy. The metal powder mixtures, wherein the constituent powders are incorporated in proportions to give the desired final composition of the memory alloy, are placed into a container and subjected to pressure such as by isostatic pressing. The compact so formed may then be sintered, encapsulated in a soft metal container and subjected to hot working, with appropriate annealing, to produce a final memory alloy having the desired composition and properties.

Having generally described the invention, a more complete understanding can be obtained by reference to certain specific examples, which are provided herein for purposes of illustration only and are not intended to be limiting unless otherwise specified. In the examples, all percentages are by weight unless otherwise specified.

EXAMPLE I:

A bar of a memory alloy having the following matrix composition was produced:

Aluminum: 12.75%
Nickel: 3%
Copper: 84.25%

The following powders were used as raw materials:

Powder A:
Cupro-aluminum: 93% Cu; 7% Al melted, atomized; grain size 40–100 $\mu$m.
Manufacturer: Baudier Powder B:
Aluminum pre-mix 202 AC: 96% Al; 4% Cu, grain size 23–28 $\mu$m
Manufacturer: Alcoa Powder C:
Pure nickel: 100%

Grain size 44 μm

Mond-Nickel (e.g. Int. Nickel Co.)

The following amounts were mixed for 10 minutes in a tumble mixer:

| | |
|---|---|
| Powder A: | 903.03 g |
| Powder B: | 66.97 g |
| Powder C: | 30 g |
| Total | 1000 g |

240 g of this powder mixture were poured into a rubber tube with an inner diameter of 20 mm and pressed isostatically at a pressure of 8000 bar into a cylinder 18 mm in diameter and 220 mm in height. The slug was reduced and pre-sintered for 1 hour at 950° C. in a stream of hydrogen, and then the sintering was completed by heating for 19 hours at a temperature of 950° C. in a stream of argon. The rough sintered billet was turned to a diameter of 17 mm, inserted into an annealed copper tube with an outside diameter of 20 mm and completely encapsulated by capping and soldering the ends in an argon atmosphere. The workpiece formed in this manner was then alternately subjected to hot working and a homogenizing annealing in a stream of argon for 1 hour at 950° C. In this example, the hot working consisted of rotary swaging at 950° C., whereby in the first pass the diameter of the bar was reduced to 18 mm, and with each additional pass it was reduced another 2 mm. There was one homogenization annealing for each two hot working operations. When the bar had been reduced to a diameter of 8 mm, it was finally annealed for 15 minutes in an argon stream at 950° C. and then immediately quenched in water. The density of the workpiece was 99.5–99.8% of the theoretical value. The aluminum oxide content, present as inclusions, amounted to 1.8%.

EXAMPLE II

A strip was produced of a memory alloy having the following final matrix composition:

Aluminum: 13%

Nickel: 3%

Copper: 84%

The powders listed in Example I were mixed in the following amounts for 12 minutes in a tumble mixer:

| | |
|---|---|
| Powder A: | 900.2 g |
| Powder B: | 69.8 g |
| Powder C: | 30 g |
| Total: | 1000 g |

240 g of this powder mixture were poured into a heat softened tombac tube with an inside diameter of 20 mm and a wall thickness of 1.6 mm and completely encapsulated by capping the ends and soldering them shut in an argon atmosphere. Then the tube and the powder were isostatically pressed at a pressure of 12,000 bar. The slug was then reduced and pre-sintered for 1½ hours at 850° C. in a stream of hydrogen, and then the sintering was completed by heating for 22 hours at 820° C. in a stream of argon. Next, the workpiece was reduced by two circular swaging passes at 900° C. to 18 and 16 mm in diameter respectively and homogenized for 1 hour at 920° C. in a stream of argon. Then came two more circular swaging passes at 900° C. so that the bar finally had a diameter of 13 mm. After repeated homogenization for 1 hour at 920° C., the bar was rolled down to a strip 1.5 mm in thickness and 20 mm wide in several sequential hot rolling operations each with a 20–25% reduction of cross section. After a final annealing at 950° C. for 12 minutes the strip was quenched in water. The density of the finished strip amounted to 99.7% of the theoretical value. The aluminum oxide content inclusions was 1.8%.

A comparison of this alloy with a cast alloy of 13% aluminum, 3% nickel and 84% copper serves to illustrate the differences in the mechanical properties of the alloys of this invention from those of conventional alloys:

| | Cast Alloy | Alloy of This Invention Containing Inclusions |
|---|---|---|
| Grain size (μ) | 1500 | 30 |
| Tensile Strength (MPa) | 400 | 540 |
| 0.2% Yield Strength (MPa) | 360 | 310 |
| Elongation (%) | 0.6 | 4.1 |
| Hardness HV10 (950° C. C/10'/WQ) | 180–210 | 250–280 |
| Work done in unidirectional transformation ($MJ/m^3$) (load 4 kg) | 1.23 | 3.38 |

Samples of this alloy were subjected to annealing temperatures up to 950° C. for 50 hours, 200 hours and 500 hours and then tested. No decrease in the mechanical characteristics nor grain growth could be detected. Even after annealing for any length of time at 950° C., the average crystallite diameter remained at 30 μm.

EXAMPLE III

A bar was produced from a memory alloy having the following final composition:

Aluminum: 13%

Nickel: 3%

Copper: 83%

Yttrium oxide: 1%

The following powders were used as raw materials:

Powder A:

Cupro-aluminum: 93% Cu; 7% Al, melted, atomized;

grain size 40–100 μm

Manufacturer: Baudier

Powder B:

Aluminum pre-mix 202 AC: 96% Al; 4% Cu, grain size 40–100 μm

Manufacturer: Alcoa

Powder C:

Pure nickel: 100% Ni grain size 44 μm

Mond-Nickel (e.g. Int. Nickel Co.)

Powder D:

Yttrium oxide: 100% $Y_2O_3$, grain size $<1$ μm

The following amounts were mixed, ground and mechanically alloyed in toluene for 8 hours in an attritor:

| | |
|---|---|
| Powder A: | 889.4 g |
| Powder B: | 70.6 g |
| Powder C: | 30 g |
| Powder D: | 10 g |

-continued

| | |
|---|---|
| Total: | 1000 g |

The powder mixture was dried to evaporate the toluene and then 240 g were poured into an annealed copper tube with an inside diameter of 18 mm and a wall thickness of 2 mm. The ends were capped and soldered shut in an argon atmosphere to completely encapsulate the material. Then the tube and powder were isostatically pressed with a pressure of 10,000 bar, and the slug was reduced and pre-sintered for 2 hours at 750° C. in a hydrogen/nitrogen stream and then finally sintered for 25 hours at 800° C. in a stream of argon. Next, the workpiece was alternately subjected to two circular swaging operations followed by homogenization annealing at 900° C. as in Example I. When the bar reached 6 mm it was subjected to a final annealing for 10 minutes at 1000° C. in a stream of argon and quenched in water. The density of the matrix was 99.5% of the theoretical value. The temperature $M_S$ of the martensite transition was 150° C. The average grain size was 28 μm.

EXAMPLE IV

A square bar was produced from a memory alloy having the following final composition:

Aluminum: 13%
Nickel: 3%
Copper: 83.5%
Titanium oxide: 0.5%

Powders A, B, C and D' (100% titanium dioxide) were weighed out as follows and mixed, ground, and mechanically alloyed for 12 hours under ethyl alcohol in a ball mill:

| | |
|---|---|
| Powder A: | 894.8 g |
| Powder B: | 70.2 g |
| Powder C: | 30 g |
| Powder D': | 5 g |
| Total: | 1000 g |

After evaporating the ethyl alcohol, 250 g of this powder mixture were poured into a rubber tube 35 mm in inside diameter and pressed isostatically at 14,000 bar into a cylinder 31 mm in diameter and 80 mm in height. The slug was reduced and pre-sintered for 1 hour at 920° C. in a hydrogen stream and then finally sintered for 20 hours at 950° C. in a stream of argon. The rough sintered billet was turned down to a diameter of 30 mm, placed in the chamber of an extrusion press and extruded at 780° C. into a square bar with a cross-section 8 mm on an edge. The reduction ratio (reduction in cross-section) was 11:1. Then the bar was homogenized at 920° C. for 30 minutes and then reduced to an edge length of 6 mm by two passes on a hot drawing bench at 750° C. After a final 15 minutes annealing at 900° C. in an argon stream the bar was quenched in water. The matrix density of the finished bar was 99.8% of the theoretical value. The martensite transition temperature was 170° C. The average crystallite diameter was 26 μm at a Vickers hardness (HV10) of 280 units.

EXAMPLE V

A round plate was produced from a memory alloy having the following final composition:

Aluminum: 20.5%
Nickel: 79%
Yttrium oxide: 0.5%

The following powders were used as raw materials:

Powder $A_1$:
Nickel/Aluminum pre-alloy: 50% Ni; 50% Al, melted, atomized,
grain size 44–100 μm Powder $B_1$:
Pure nickel: 100% Ni.
Grain size: 44 μm
Mond-Nickel (e.g. Int. Nickel Co.)

Powder $C_1$:
Yttrium oxide: 100% $Y_2O_3$,
grain size < 1 μm

The following amounts were mixed, ground and mechanically alloyed for 20 hours under toluene in an atrritor:

| | |
|---|---|
| Powder $A_1$: | 410 g |
| Powder $B_1$ | 585 g |
| Powder $C_1$ | 5 g |
| Total: | 1000 g |

After removing the toluene by drying, 1000 g of this powder mixture were poured into a plastic tube 66 mm in inside diameter and isostatically pressed at 12,000 bar into a cylinder 60 mm in diameter and 80 mm in height. The slug was reduced and pre-sintering for 1 hour at 1200° C. in a stream of hydrogen/nitrogen and then finally sintered for 25 hours at 1250° C. in a stream of argon. The rough sintered billet was turned down to a diameter of 58 mm, inserted into an annealed canister of soft iron and completely encapsulated by affixing a cover and soldering it shut in an argon atmosphere. The workpiece produced in this manner was subjected to hot working in a press forge interrupted by homogenization annealings. Through alternate forging and annealing at 1200° C. the height of the cylinder was successively reduced to ca. 32 mm. The material was compressed to ca. 95% of the theoretical density and had a diameter of 70 mm, corresponding to its loss of height. After an additional 1 hour homogenization annealing at 1230° C. the pre-formed round plate with parallel, flat frontal surfaces was placed in a forge die with offset diameters and brought to the final form in several steps that were interrupted by intermediate annealings at temperatures between 1220° C. and 1100° C. The 20 mm thick plate had a maximum outside diameter of 90 mm, a radial bulge of 5×5 mm on the upper side, and on the bottom side a central recess 20 mm in diameter and 5 mm in axial depth. After a final 15 minutes annealing at 1300° C. the plate was quenched in water. The matrix density was 99.2–99.5% of the theoretical value. The martensite transition temperature $M_S$ was 130° C.

EXAMPLE VI

A sheet was produced from a memory alloy with the following final composition:

Aluminum: 20%
Nickel: 77.8%
Cobalt: 1.2%
Titanium oxide 1%

The following powders were used as raw materials:

Powder $A_2$:
Nickel/Aluminum pre-alloy: 50% Ni; 50% Al, melted, atomized;
grain size 44–100 μm Powder $B_2$:

Pure aluminum: 100% Al,
grain size 44 μm
Manufacturer: Alcoa.

Powder $C_2$:
Nickel/Cobalt-pre-mixture:
98.03% Ni; 1.97% Co;
grain size < 44 μm Powder $D_2$:
Titanium oxide: 100% $TiO_2$,
grain size < 1 μm The following amounts were mixed, ground and mechanically alloyed for 25 hours under ethyl alcohol in a ball mill:

| | |
|---|---|
| Powder $A_2$: | 720 g |
| Powder $B_2$: | 40 g |
| Powder $C_2$: | 1220 g |
| Powder $D_2$: | 20 g |
| Total: | 2000 g |

After the ethyl alcohol was evaporated, 2000 g of this powder mixture were poured into a plastic tube 66 mm in inside diameter and isostatically pressed at 12,000 bar into a cylinder 60 mm in diameter and 160 mm in height. The slug was reduced and pre-sintered for 1 hour at 1180° C. in a hydrogen/nitrogen stream and then finally sintered for 25 hours at 1220° C. in a stream of argon. The rough sintered billet was turned down to a diameter of 58 mm, inserted into an annealed tube of corrosion resistant steel 64 mm in outside diameter and completely encapsulated by capping the tube and soldering the lid shut in an argon atmosphere. The workpiece produced in this manner was subjected to hot working in a press forge, interrupted by homogenization annealings. Through alternate forging and annealing at 1180° C., the height of the cylinder was successively reduced to ca. 64 mm. The material was compressed to ca. 95% of the theoretical density and then had a diameter of 70 mm which matched the chamber of the extrusion press. After an additional homogenization annealing for 1 hour at 1200° C., the preformed round billet was placed in an extrusion press and extruded at 1250° C. into a flat bar of rectangular cross-section 10×50 mm. The reduction ratio (cross-section reduction) was 7.8:1. Then the bar was homogenized 30 minutes at 1300° C. and a piece 250 mm long was cut off. This piece was rolled in several sequential hot rolling steps with corresponding intermediate annealings, each at 1250° C. to 1150° C., to a sheet 2 mm thick. After each two passes on the transverse mill, each with 20% reduction of cross-section, one was made on the longitudinal mill with 5% cross section reduction (pass to straighten the sheet). For each two transverse and one longitudinal pass there was an intermediate annealing of 15 minutes. After a final 10 minutes annealing at 1320° C., the sheet was quenched in water. The density of the matrix of the finished sheet was 99.8%. The martensite transition temperature $M_S$ was 200° C.

The inclusion-containing memory alloys produced according to the invention have a fine-grained texture with a crystallite diameter of 100 μm at the most. In general an average crystallite diameter of 30 μm and less can be attained, depending on the selection of the raw material powder. The invention is not limited to the characteristic dimensions given in the examples. In general the powder compositions and mixture proportions can be varied and substituted so that the metallic matrix may have the following composition:

Cu/Al or Cu/Al/Ni System:
Aluminum: 10.5 to 15%
Nickel: 0 to 6%
Copper: Balance

Nickel can also be partially or completely replaced by at least one of the following elements:
Manganese
Iron
Cobalt Ni/Al or Ni/Al/Co System:
Aluminum: 17 to 26%
Nickel: Balance Nickel can also be partially or completely replaced by cobalt.

In the Cu/Al/Ni system the substitution of nickel by iron in the range of 2–3% has little effect on the transition temperature, while in the range above that $M_S$ is markedly increased. Substitution of nickel by manganese definitely reduces $M_S$ over the entire range (at constant aluminum content of about 11 to 14%). In all systems (the original system Cu/Al/Ni and the substituted systems) the $M_S$ decreases when the aluminum content increases. The result is a very broad range for the martensite transition temperature, which can be varied from −200° C. to +300° C. Because it is possible to induce one-way and two-way shape memory effects in these alloys, along with the great range of variation of the $M_S$ temperature and excellent mechanical characteristics, broad areas of application have been opened. These areas of application extend from temperature control to thermomechanical energy converters to overload protection in electrical apparatus.

Having now fully described the invention, it will be apparent to one of ordinary skill in the art that many changes and modifications can be made thereto without departing from the spirit or scope of the invention as set forth herein.

What is claimed as new and desired to be secured by Letters Patent of the United States is:

1. A memory alloy prepared by powder metal technology consisting essentially of aluminum and at least one metal selected from the group consisting of copper, nickel, or copper and nickel having the β-phase solid solution structure which forms a matrix having a fine grained texture with a crystallite diameter of at most 100 μm, the Cu/Al or Cu/Al/Ni alloy containing Al in the range of 10.6–15.0 percent, and Ni in the range of 0–6 percent, the balance being copper, and the Ni/Al alloy containing Al in the range of 17–26%, the balance being Ni, and, dispersed in said matrix, 0.5 to 2.0 percent of finely divided inclusions of at least one metal oxide having a particle size of 1.0 nm to 1.0 micron.

2. The memory alloy of claim 1, wherein said inclusions are at least in part aluminum oxide.

3. The memory alloy of claim 1, wherein the metal oxide inclusions comprise 0.5 to 2% by weight of the total mass of the alloy.

4. The memory alloy of claim 1, wherein nickel is partially or completely replaced by a metal selected from the group consisting of manganese, iron, cobalt.

5. The memory alloy of claim 1, wherein said β-phase matrix consists essentially of 17 to 26% by weight of aluminum, the balance nickel and cobalt and inevitable impurities.

6. The memory alloy of claim 1, having an average crystallite diameter of 30 μm.

7. The memory alloy of claim 6 wherein the average crystallite diameter remains constant during annealing at 950° C.

8. The memory alloy of claim 1, having a martensite transition temperature $M_S$ in the temperature range −200° to +300° C.

* * * * *